US009125533B2

(12) United States Patent
Babikian

(10) Patent No.: US 9,125,533 B2
(45) Date of Patent: Sep. 8, 2015

(54) DRYER AND TOWEL DISPENSER COMBINATIONS AND METHODS OF OPERATING THE SAME

(71) Applicant: BOBRICK WASHROOM EQUIPMENT, INC., North Hollywood, CA (US)

(72) Inventor: Dikran Babikian, Glendale, CA (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 199 days.

(21) Appl. No.: 13/791,845

(22) Filed: Mar. 8, 2013

(65) Prior Publication Data

US 2014/0250715 A1 Sep. 11, 2014

(51) Int. Cl.
*F26B 11/00* (2006.01)
*A47K 10/48* (2006.01)

(52) U.S. Cl.
CPC ..... *A47K 10/485* (2013.01)

(58) Field of Classification Search
CPC ..... F26B 5/00; F26B 11/00; F26B 11/06; B65H 16/06; B65H 18/04; B65H 49/26; B65H 49/32; B65H 75/18; A47K 10/485; G07F 11/02; G07F 11/04
USPC ..... 34/90, 201, 210, 218; 392/381, 384; 4/619; 5/655; 242/564.2, 598.6; 312/34.8, 34.11
See application file for complete search history.

(56) References Cited

U.S. PATENT DOCUMENTS

| | | | | |
|---|---|---|---|---|
| 3,305,938 | A | 2/1967 | Goldstein | |
| 3,785,523 | A | 1/1974 | Goldstein | |
| 5,604,992 | A * | 2/1997 | Robinson | 34/90 |
| 5,806,203 | A * | 9/1998 | Robinson | 34/90 |
| 5,992,430 | A | 11/1999 | Chardack et al. | |
| 6,128,826 | A * | 10/2000 | Robinson | 34/90 |
| 6,185,838 | B1 | 2/2001 | Moore | |
| 7,171,761 | B1 * | 2/2007 | Hunts | 34/91 |
| 7,614,160 | B2 * | 11/2009 | Kameishi et al. | 34/90 |
| 8,347,522 | B2 * | 1/2013 | Dyson et al. | 34/90 |
| 8,544,186 | B2 * | 10/2013 | Hsu | 34/202 |
| 8,590,738 | B2 * | 11/2013 | Formon et al. | 221/217 |
| 8,813,383 | B2 | 8/2014 | Liu et al. | |
| 8,997,372 | B2 * | 4/2015 | Cennon | 34/201 |
| 2007/0023565 | A1 * | 2/2007 | Babikian | 242/598.6 |
| 2007/0151980 | A1 * | 7/2007 | Babikian et al. | 221/45 |
| 2011/0114661 | A1 * | 5/2011 | Babikian | 221/45 |

(Continued)

FOREIGN PATENT DOCUMENTS

| | | | |
|---|---|---|---|
| JP | 2009-077861 | A | 4/2009 |
| JP | 2011-019606 | A | 2/2011 |
| WO | WO 2007011747 | A2 * | 1/2007 |

(Continued)

OTHER PUBLICATIONS

International Search Report and Written Opinion mailed Jun. 3, 2014, for International Application PCT/US2014/021394, filed Mar. 6, 2014 (12 pages).

*Primary Examiner* — Stephen M Gravini
(74) *Attorney, Agent, or Firm* — Christie, Parker & Hale, LLP

(57) ABSTRACT

A dryer and towel dispenser combination and method of operating the same. The combination includes a towel dispenser for dispensing a towel through a first area, a sensor having a sensing area for sensing an object that penetrates the sensing area. The dryer is activated in response to a sensing of the object for drying the object.

13 Claims, 5 Drawing Sheets

(56) References Cited

U.S. PATENT DOCUMENTS

2012/0085776 A1* 4/2012 Babikian ..... 221/13
2012/0285033 A1 11/2012 Hsu
2013/0042494 A1 2/2013 Hsu
2014/0250715 A1* 9/2014 Babikian ..... 34/427

FOREIGN PATENT DOCUMENTS

WO WO 2010048576 A2 * 4/2010 ..... A47K 5/12

* cited by examiner

DRYER AND TOWEL DISPENSER COMBINATIONS AND METHODS OF OPERATING THE SAME

BACKGROUND

Towel dispenser and hand dryers are common in public bathrooms in commercial establishments. People using the towel dispenser tend to use multiple paper towels. Moreover, the hand dryers' often do not completely dry the user's hand.

SUMMARY

In an example embodiment a dryer and towel dispenser combination is provided. The combination includes a towel dispenser for dispensing a towel through a first area, a sensor having a sensing area for sensing an object that penetrates the sensing area, such that the sensing area is in front of at least a portion of the first area, and a dryer activated in response to a sensing of the object for drying the object. In a further example embodiment, the object is at least one of both of a user's hands. In one example embodiment the dryer blows air, and in another example embodiment the dryer blows heated air. In yet a further example embodiment, the combination also includes a first duct and a second duct, the first duct including a first outlet and the second duct including a second outlet opposite the first outlet for discharging the air blown by the dryer there-through. In another example embodiment, the towel dispenser is sandwiched between the first and second ducts. In yet another example embodiment, the combination also includes a cavity having a first side opposite a second side, the first and second sides extending in a direction from a rear of the combination toward a front of the combination such that the cavity opens to the front of the combination, and the first outlet extends through the first side and the second outlet extends through the second side. In a further example embodiment, the towel dispenser dispenses the towel along a path, and the path extends between the outlets. In yet a further example embodiment, the towel dispenser includes an opening through which the towels will be dispensed, and the outlets are below the opening. In another example embodiment, the combination also includes a waste receptacle below the outlets. In one example embodiment, the towel dispenser includes an opening through which the towel will be dispensed, the opening being elongated along a first direction, such that the opening is longer along the first direction than along a second direction perpendicular to the first direction, and the outlets discharge air blown by the dryer at least along the first direction. In yet another example embodiment, when a user faces the combination, the first outlet discharges air blown by the dryer from a right side toward a left side and the second outlet discharges air blown by the dryer from a left side toward a right side as viewed by the user facing the combination. In yet a further example embodiment, a towel cannot be obtained from the towel dispenser without intercepting the sensing area.

In another example embodiment, a dryer and towel dispenser combination is provided. The combination includes a towel dispenser for dispensing a towel, a first area from which a towel may be obtained from the towel dispenser, a sensor having a sensing area for sensing an object that penetrates the sensing area, such that at least a portion of the sensing area and at least a portion of the first area are confined within a vertical distance no greater than 4 inches, and a dryer activated in response to a sensing of the object for drying the object. In a further example embodiment, the object is at least one of both of a user's hands. In one example embodiment the dryer blows air, and in another example embodiment the dryer blows heated air. In yet a further example embodiment, the combination also includes a first duct and a second duct, the first duct including a first outlet and the second duct including a second outlet opposite the first outlet for discharging the air blown by the dryer there-through. In another example embodiment, the towel dispenser is sandwiched between the first and second ducts. In yet another example embodiment, the combination also includes a cavity having a first side opposite a second side, the first and second sides extending in a direction from a rear of the combination toward a front of the combination, such that the cavity opens to the front of the combination, and the first outlet extends through the first side and the second outlet extends through the second side. In a further example embodiment, the towel dispenser dispenses the towel along a path, and the path extends between the outlets. In yet a further example embodiment, the towel dispenser includes an opening through which the towel will be dispensed, and the outlets are below the opening. In another example embodiment, the combination also includes a waste receptacle below the outlets. In one example embodiment, the towel dispenser includes an opening through which the towels will be dispensed, the opening being elongated along a first direction, such that the opening is longer along the first direction than along a second direction perpendicular to the first direction, and the outlets discharge air blown by the dryer at least along the first direction. In yet another example embodiment, when a user faces the combination, the first outlet discharges air blown by the dryer from a right side toward a left side and the second outlet discharges air blown by the dryer from a left side toward a right side as viewed by the user facing the combination. In yet a further example embodiment, a towel cannot be obtained from the towel dispenser without intercepting the sensing area.

In yet a further example embodiment, a method of operating a dryer and towel dispenser combination having a sensor for sensing an object within a sensing area is provided. The method includes monitoring an area through which towels are dispensed, and activating the dryer when the sensing area has been intercepted by an object. In one example embodiment, the method also includes monitoring the temperature of a motor of the dryer and allowing the dryer to operate only when the monitored temperature is not greater than a desired level.

In yet a further example embodiment, a method of operating a dryer and towel dispenser combination having a sensor for sensing an object within a sensing area is provided. The method includes turning the dryer on when a user tries to obtain a towel from the dispenser, and maintaining the dryer on for a first time predetermined time period thereafter. In another example embodiment, the method also includes maintaining the dryer on after the first predetermined period of time as long as an object is intercepting the sensing area. In one example embodiment, maintaining the dryer on after the first predetermined period of time includes maintaining the dryer on for up to a second predetermined period of time as long as the object is intercepting the sensing area. In yet another example embodiment, the dryer cannot be turned on after the second predetermined period of time unless the object is withdrawn from intercepting the sensing area. In a further example embodiment, the object is at least one of the user's hands. In yet a further example embodiment, the method also includes sensing a temperature of a motor of the dryer, and preventing the motor from being operated when the sensed temperature exceeds a predetermined level.

In another example embodiment, a method of operating a dryer and towel dispenser combination having a sensor for sensing an object within a sensing area is provided. The method includes sensing a user trying to obtain a towel from the dispenser, and after a first predetermined period of time has passed since the sensing, turning the dryer on if an object is intercepting the sensing area. In yet another example embodiment, the method also includes maintaining the dryer on for up to a second predetermined period of time as long as an object is intercepting the sensing area. In a further example embodiment, the dryer cannot be turned on after the third predetermined period of time unless the object is withdrawn from intercepting the sensing area. In yet a further example embodiment, the object is at least one of the user's hands. In another example embodiment, the method also includes sensing a temperature of a motor of the dryer, and preventing the motor from being operated when the sensed temperature exceeds a predetermined level.

In yet a further example embodiment, a method of operating a dryer and towel dispenser combination having a sensor for sensing an object within a sensing area is provided. The method includes selecting between a first and a second mode of operation, such that when selecting the first mode, the method includes turning the dryer on when a user tries to obtain a towel from the dispenser, and maintaining the dryer on for a time predetermined time period thereafter, and when selecting the second mode of operation, the method includes, sensing the user trying to obtain a towel from the dispenser, and after a second predetermined period of time has passed since the sensing the user trying to obtain a towel, turning the dryer on if an object is intercepting the sensing area. In one exemplary embodiment, the object is a user's hands.

In another example embodiment a hand dryer is provided including a sensor having a sensing area for sensing at least a user's hand that penetrates the sensing area, and at least a blower. A first outlet is opposite a second outlet such that air blown by the at least a blower is discharged through the first and second outlets, and when a user faces the dryer, the first outlet discharges the air from a right side toward a left side and the second outlet discharges the air from a left side toward a right side as viewed by the user facing the dryer.

DETAILED DESCRIPTION

Figure 1:
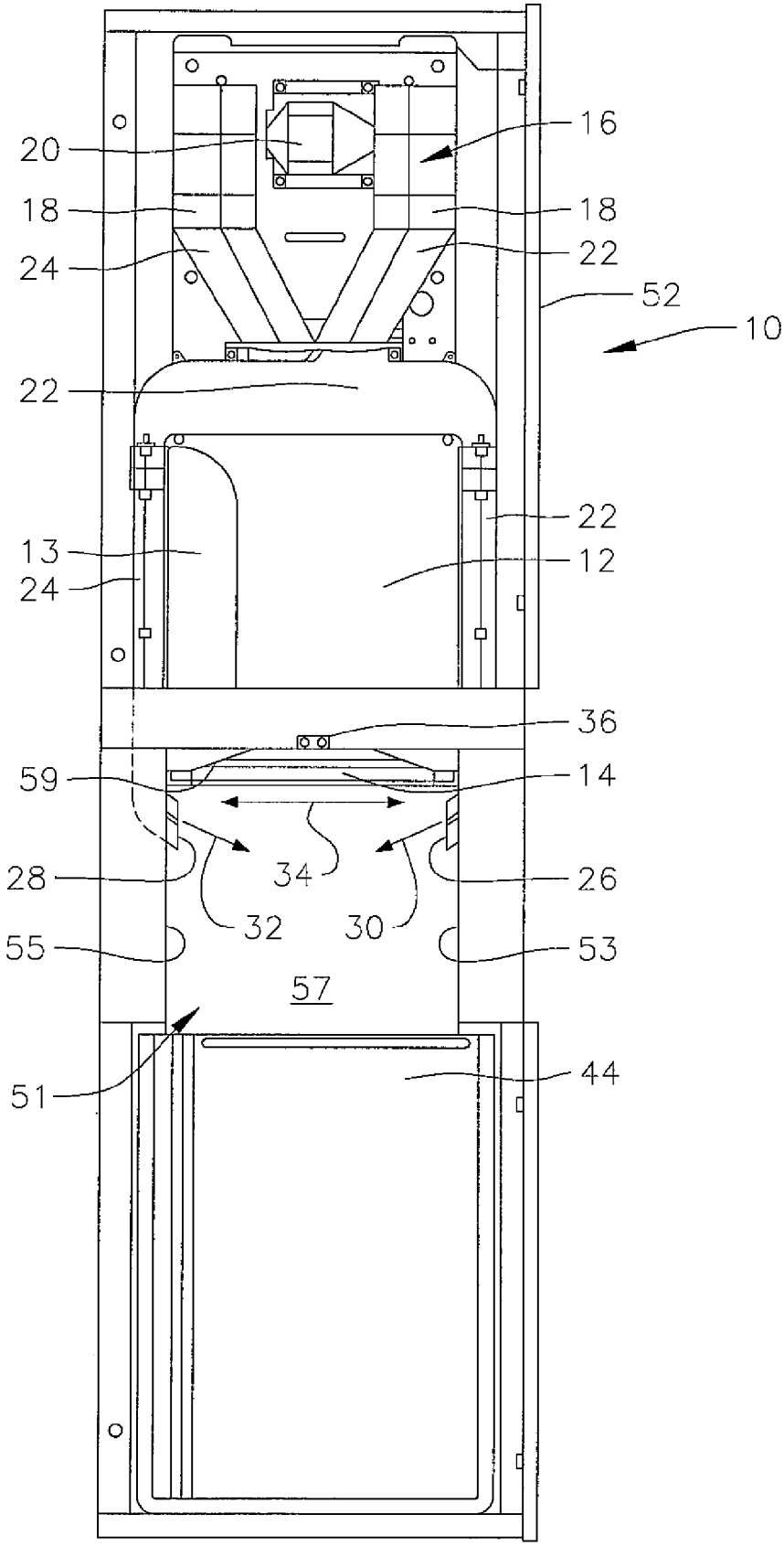
FIG. 1 is a front view of an example embodiment dryer and towel dispenser combination including a waste receptacle with a front door(s) removed.

In an embodiment, an air dryer and towel dispenser combination 10 is provided. As shown in FIG. 1, the combination includes a towel dispenser 12 for dispensing towels at a location through a dispensing opening 14, which in an example embodiment is an elongated opening or slot. Paper towels are loaded in the dispenser and are dispensed through the opening 14. The towels are described herein as being paper towels for illustrative purposes. Other types of towels made from different materials may also be used. The dispenser may be any type of dispenser that dispenses paper towels. For example it may be a dispenser that dispenses a preset length of paper from a roll each time a user pulls on a portion of the paper towel that extends from the dispensing opening, or each time a sensor senses the user's hand proximate the opening. In the example embodiment shown in FIGS. 1 and 3, the towel dispenser holds a plurality of interfolded towels. Once a towel is pulled by a user through the dispensing opening, another towel partially exits the dispensing opening and is ready to be pulled out of the dispensing opening. An air dryer 16 is provided having a blower 20 driven by motor 42 and optionally a heater for heating the air being blown (shown in FIG. 1), and first and second ducts or plenums 22, 24 extending opposite each other and having corresponding first and second outlets 26, 28 opposite each other. In the shown example embodiment, a heater 18 is provided in each plenum for heating the air blown through such plenums. Other embodiments may not include such heaters. The air from the blower 20 is guided by the plenums to their corresponding outlets and exits the first outlet 26 of the first plenum 22 in a direction opposite the direction of the air exiting the second outlet 28 of the second plenum 24. In an example embodiment, the air from the first outlet 26 is directed along arrow 30 towards the second outlet and downward, while the air from the second outlet 28 is directed along arrow 32 toward the first outlet and downward. In another embodiment, air from the blower may be fed to a single plenum which is then divided into the two plenums. In other example embodiments, each plenum 22, 24 may be defined by multiple sub-plenums.

In an example embodiment, the towel dispensing opening 14 is located between the plenum outlets 26, 28, such that the towel dispensing opening 14 is elongated along a direction 34 extending from one outlet toward the other outlet of the plenums. In an example embodiment, the outlets 26, 28 are located below the towel dispensing opening 14 as for example shown in FIG. 1.

Figure 2:
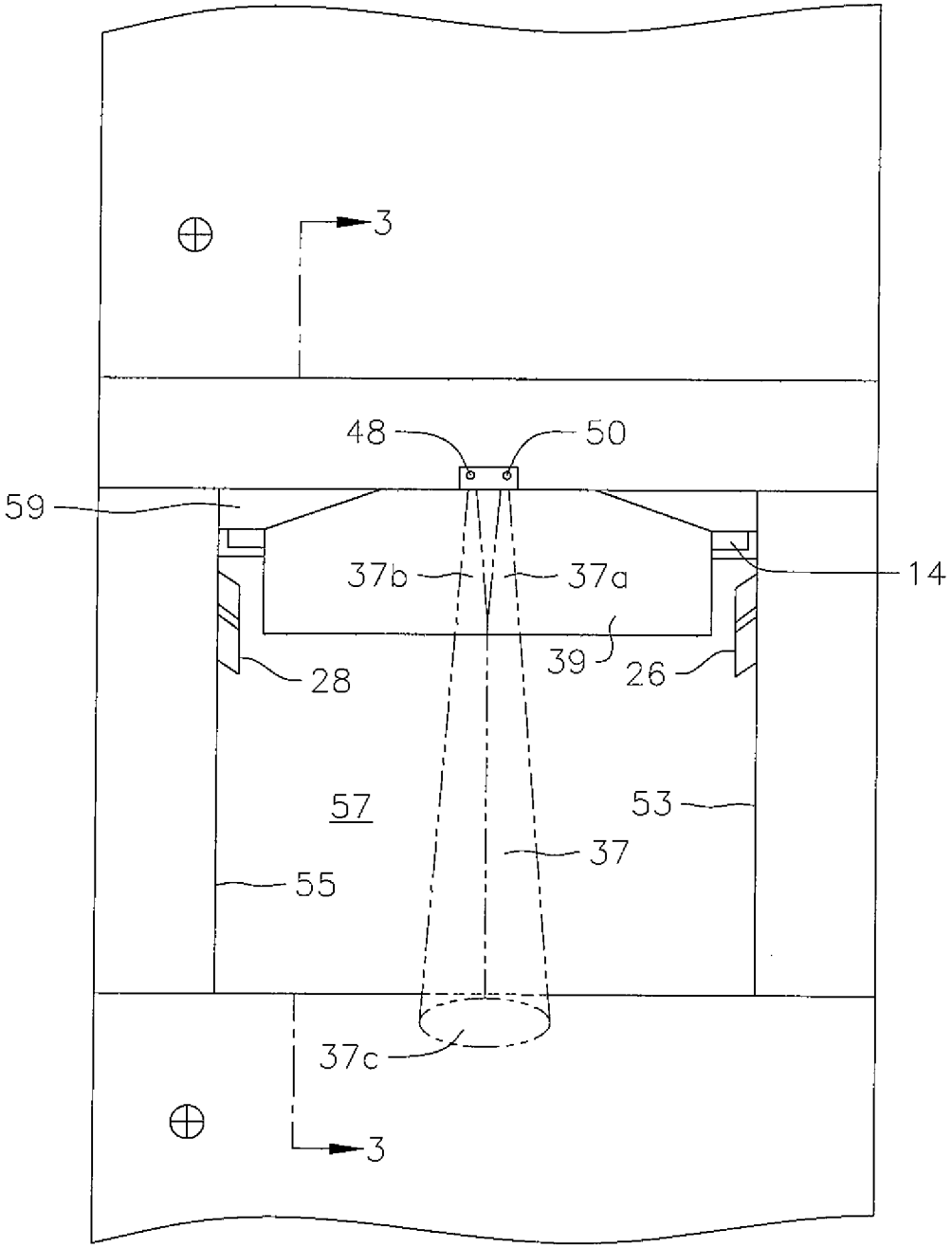
FIG. 2 is a partial front view of an example embodiment dryer and towel dispenser combination depicting a sensing area of a sensor.

In an example embodiment, a sensor 36 is provided for providing a signal when sensing an object such as a user's hands in its sensing area 37. An example sensor is an infrared (IR) sensor. Although referred to as an "area" the sensing area is in many examples are three-dimensional, e.g., it may include a volume of space. For example in the embodiment shown in FIG. 2, the sensing area is conical having a generally elliptical cross-section 37*c* and is formed by two adjacent cones 37*a*, 37*b*. The volume or size of the sensing area may be varied so that it is larger or smaller than what is shown in FIG. 2. In an example embodiment, the size of the sensing area is of sufficient size to ensure that it is intercepted by a user (e.g., by at least a user's hand) when a user tries to obtain a paper towel 39 from the dispenser. Such goal may be achieved without the area covering an area spanning an entire width of a towel being dispensed. The size of the sensing area 37 shown in FIG. 2 may be sufficient. For illustrative purposes, the invention is described herein in relation to a user's hands intercepting the sensing zone for activating the dryer. However, it should be understood that any other part of the user's body or any other object may be used to intercept the sensing area of the sensor. A paper towel reach zone, also referred to herein for convenience as the "reach zone" is a zone (i.e., an area or a volume of space) that must intercepted by a user's hands when attempting to pull on or otherwise obtain a paper towel through the dispensing opening of the paper towel dispenser. For example, the reach zone is the location that a user places his/her hand(s) on a paper towel in order to pull the paper towel, or the location a user places his/her hands for activating the automated dispensing of a paper towel. For instance, in the example embodiment shown in FIG. 3, the reach zone 41, is the area of the paper towel 39 extending beyond the dispensing opening 14. Once the sensor 36 senses the user's hand in its sensor area it sends a signal to a controller or processors 40 (FIG. 4). In an example embodiment, the controller 40 is a PC board. The controller 40 then sends a signal to turn on the motor 42 for driving the blower 20 for blowing air through the plenums 22, 24. If heaters are provided, they may be activated such that the air blown through the plenums is heated. The heater(s) and motor in an example embodiment may be battery operated, or electrically operated or using other energy sources.

Figure 3:
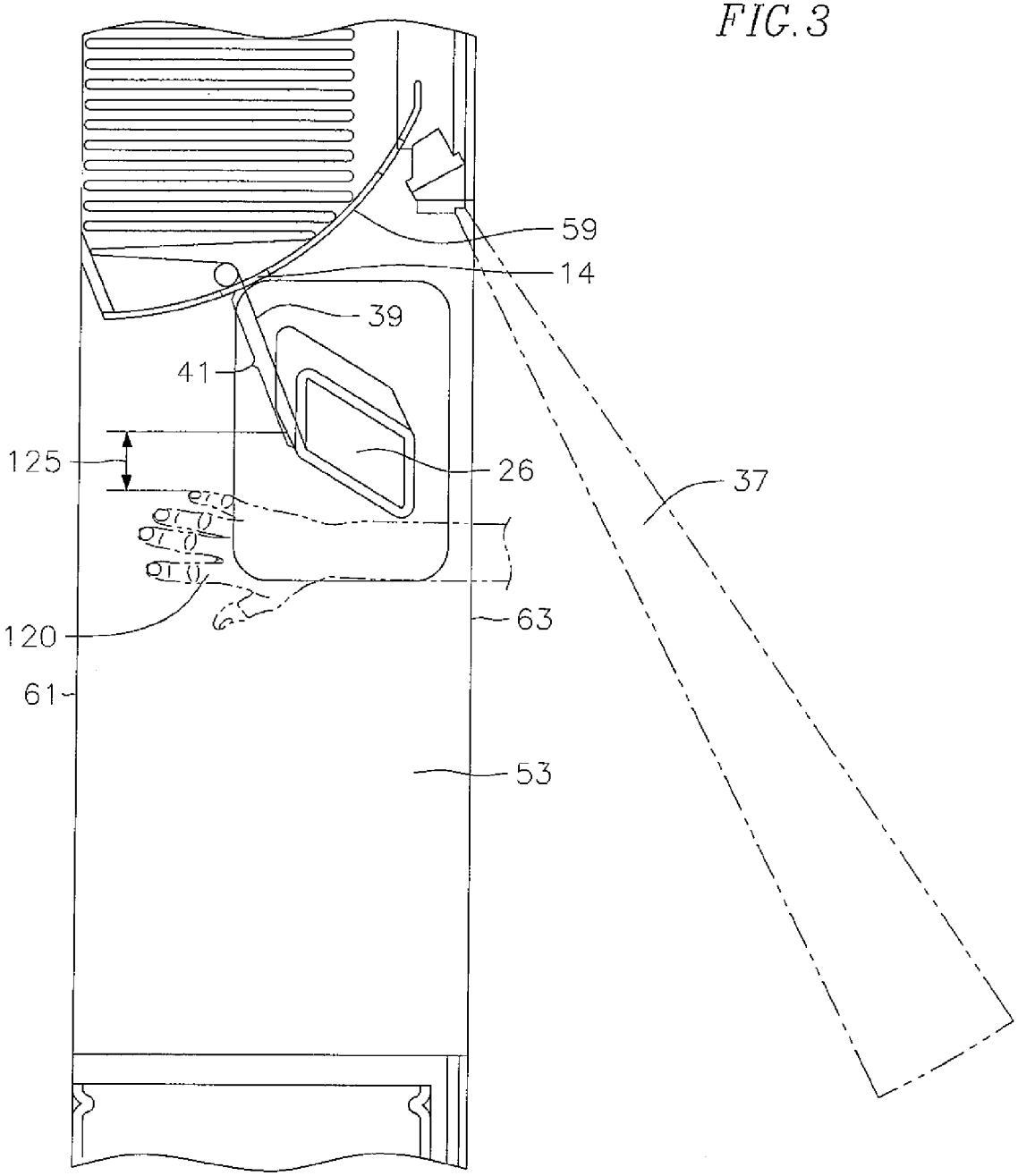
FIG. 3 is a cutaway view of the example embodiment dryer and towel dispenser combination shown in FIG. 2 taken along arrow 3-3.
Figure 4:
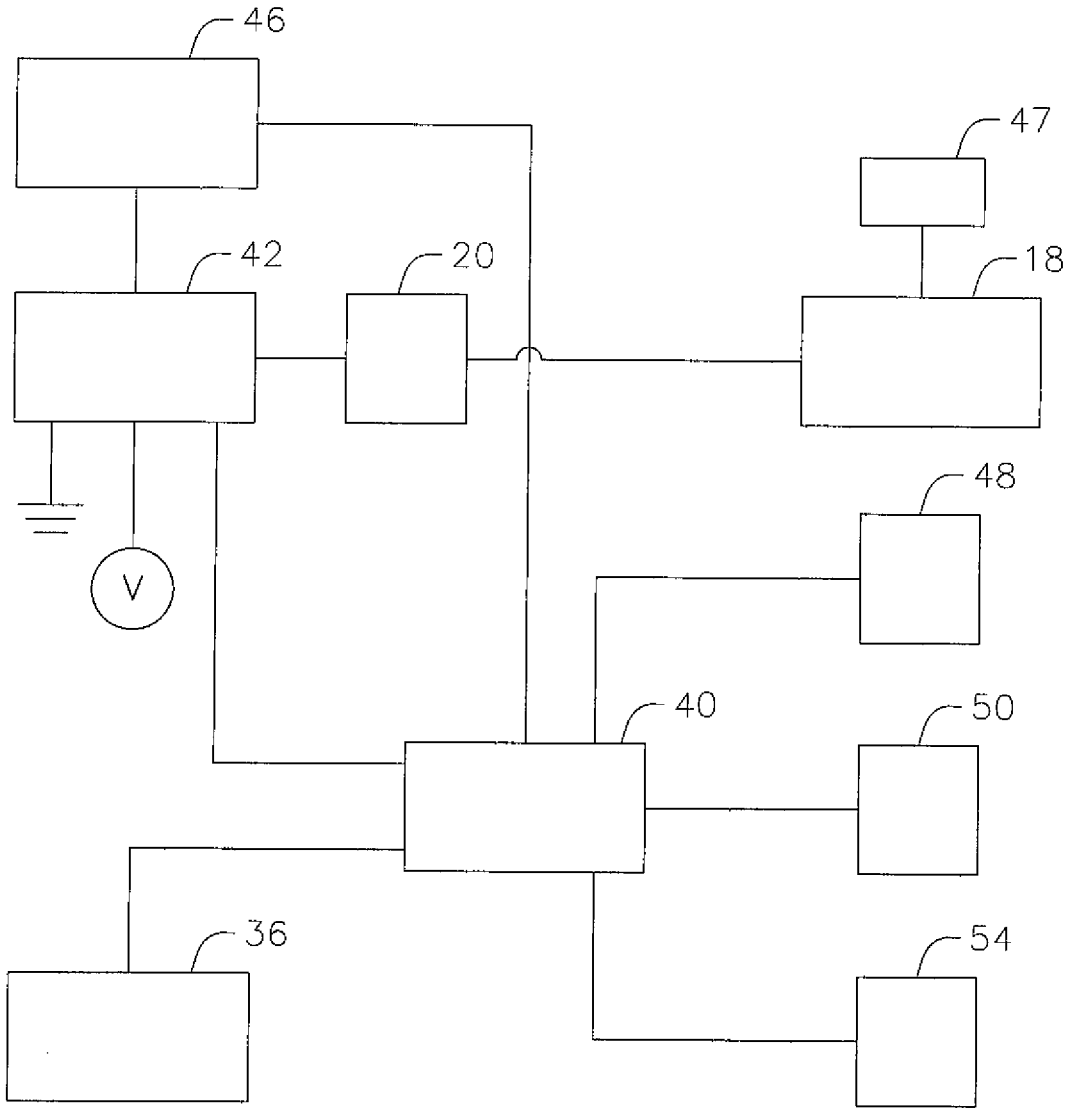
FIG. 4 is a schematic view of the operating components of an example embodiment dryer and towel dispenser combination.

In an example embodiment, any part of the reach zone and an area that a user must place his/her hands 120 for being dried by the dryer is confined within a vertical distance 125 no greater than 4 inches (FIG. 3). In other words the maximum distance between any part of the reach zone and such area where a user has to place his/her hand(s) for drying by the dryer in no greater than 4 inches. By limiting the vertical distance 125 to no greater than 4 inches, the example embodiment combination complies with the requirements of the American with Disabilities Act (ADA) as well with the Australian DDA standards, AS1428.1-2009 and United Kingdom BSI British Standards, BS8300:2009, Building Regulations Document M. In addition, the example embodiment combination is also dimensioned for complying with these Act and Standards.

In an embodiment as shown in FIGS. 1 to 3, the dryer and towel dispenser combination forms a cavity 51 having a first side 53 opposite a second side 55, as for example a right side 53 opposite a left side 55, as viewed by a user facing the combination. The two sides extend from a rear 61 of the cavity toward the front 63 (FIG. 3). A back wall 57 may be formed in the rear. The back wall may be part of the combination or may be a wall of a structure against which the combination is mounted. The first and second outlets 26, 28 are formed through the first and second sides 53, 55, respectively. An upper wall 59 extends from the back wall and between the first and second sides. The towel dispensing opening 14 extends through the upper wall. In an embodiment, the upper wall is part of the towel dispenser 12. In the shown example embodiment, as for example shown in FIG. 3, the towel holder includes a towel retainer 13 for retaining a plurality of interfolded towels. The dryer 16 is mounted over the towel dispenser 12, and the plenums 22 and 24 extend from the blower 20 and on either side of the towel dispenser such that the towel dispenser is sandwiched between the two plenums. The two plenums extend to their respective outlets. To dry their hands or another object using air blown by the dryer, a user facing the cavity 57 places their hands or objects at least partly in the cavity in a location between the outlets 26, 28 and below the towel dispenser opening 14.

In a further example embodiment, a waste receptacle 44 is provided below the paper towel dispensing outlet (FIG. 1). In an example embodiment, the paper towel dispenser 12, the dryer 16 and the receptacle 44, if one is provided, are housed in a housing 52. The housing may have a first door (not shown) for covering the dryer and the towel dispenser, and second door for covering the receptacle if one is used. In another embodiment, a single door with an opening for allowing for access to the dispenser opening 14 and plenum outlets 26, 28 (i.e., it allows for a user to access cavity 51) is used to cover the dryer, the towel dispenser and the receptacle.

In an example embodiment, once a user reaches to pull a towel or to activate the towel dispenser, i.e., once a user places his/her hands at the reach zone or attempts to obtain a towel from the towel dispenser, the user intercepts the sensing zone and in turn activates the dryer, thereby allowing the dryer to at least partially dry his/her hands before pulling a towel from the dispenser to further dry his/her hands. As can be seen, in the example embodiment, drying air (whether heated or not) is provided along paths transverse to the direction in which the user moves his/her hands to obtain a paper towel and transverse to the direction through which the paper towel is dispensed, and provides drying air to each hand. For example, air from the first or right outlet 26 will unobstructively strike a user's right hand, while air from the second or left outlet 28 will unobstructively strike a user's left hand. Upon completion, the used towel may be discarded in the receptacle 44, if one is provided or may be discarded in another waste receptacle.

In a further example embodiment, a temperature sensor 46, such as for example a thermocouple is provided for sensing the temperature of the motor. In another example embodiment, operation indicator lights, such as a red light 48 and a green light 50 are provided. In an example embodiment, the lights are provided at a location such that they are visible by the user. In an example embodiment, these lights are provided proximate the sensor 36 and may be on a housing of the sensor as for example shown in FIG. 2.

As the dryer, in an example embodiment, is enclosed in housing 52 which is covered, the dryer may sometimes overheat due to overuse. In an example embodiment, the red light would illuminate when the temperature (sensed or otherwise measured) of the dryer motor is above a desired level, and a green light would turn on or flash, as for example when the sensed temperature is below such desired level. If the temperature exceeds the desired level, a signal is sent by the temperature sensor to the controller 40 and the controller turns on the red light. Once the temperatures drops below the desired level, the controller causes the red light to turn off and the green light to illuminate. In one example embodiment, the controller prevents the dryer from operating when a measured temperature of the dryer motor exceeds a desired level, as for example by not directing power to the motor. In an example embodiment, once the sensed temperature of the dryer exceeds the desired level, the dryer gets turned off by the controller. In another example embodiment, the red light would illuminate when the sensed temperature of the dryer motor is above a second desired level, and a green light would turn on or flash, as for example when the sensed temperature is below a first desired level. If the sensed temperature exceeds the second desired level, a signal is sent by the temperature sensor to the controller 40 and the controller turns on the red light. Once the temperatures drops below the first desired level, the controller causes the red light to turn off and the green light to illuminate. In one example embodiment, the controller prevents the dryer from operating when a measured temperature of the dryer motor exceeds the first desired level, as for example by not directing power to the motor. In an example embodiment, once the sensed temperature of the dryer exceeds the second desired level, the dryer gets turned off by the controller. In another example embodiment, the controller includes a timer that measures the amount of time of continuous operation of the dryer. If the dryer continues to operate more than a predetermined amount of time, the dryer again is shut off by the controller. In this regard, the dryer is shut off before it overheats due to continuous overuse. Moreover, in some example embodiments, the heater 18 has a mechanical shut-off switch 47 which includes a material that melts at a predetermined temperature, or which expands at a predetermined temperature, to cut-off power to the heater and thereby turn-off the heater (FIG. 4).

As such, when a predetermined temperature is exceeded, the switch 47 interrupts the power delivery to the heater turning off the heater.

Figure 5:
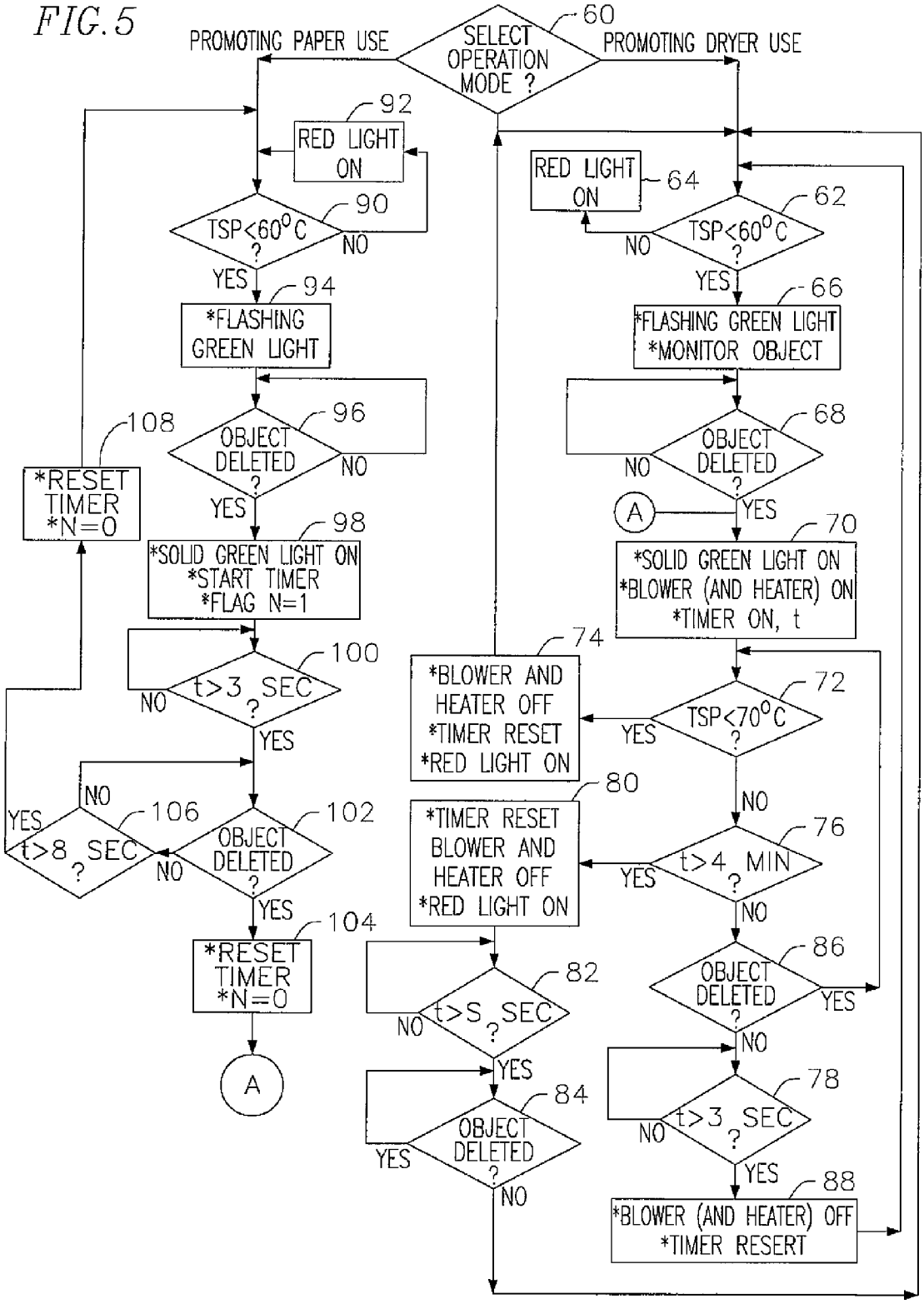
FIG. 5 depicts a flow chart of example operations of an example embodiment dryer and towel dispenser combination

In one example embodiment, a switch 54 allows an operator to select the type of operation. The switch in an example embodiment may be used to select between an operation that promotes dryer usage (referred herein as "dryer mode" for convenience) and an operation that promotes towel usage (referred to as "towel mode" for convenience) (item 60, FIG. 5). When selecting dryer mode, the controller, checks whether the temperature of the dryer motor, as for example monitored by temperature sensor 46 is less than a first predetermined level (item 62). In an example embodiment, the first predetermined first level is 60° C. If the temperature is not less than 60° C., the red light (if one is provided) is turned on (item 64). If the temperature is less than the first predetermined level, the green light, if available, begins to flash (item 66). If an object is detected by the object sensor, such as object sensor 36 (item 68), a green light may be turned one if provided, a timer for measuring the continuous operation of the dryer (i.e., the dryer motor) is turned on and the dryer (i.e., the dryer motor) is turned on blowing air through the outlets (item 70). While the dryer is on, if the temperature of the dryer motor as measured by the temperature sensor exceeds a second predetermined level, which in an example embodiment is greater than the first predetermined level, as for example 70° C. (item 72), the dryer is turned off and the red light, if available, may be turned on (item 74). When the measured temperature of the dryer motor drops below the first predetermined level (item 62) the dryer is ready for operation as per items 66, 68, 70, described above. While the dryer is on (item 74) if the total amount of continuous operation of the dryer has not exceeded a first predetermined amount of time, as for example 4 minutes (item 76) and if an object is sensed by the object sensor 36, the dryer continues to remains on for a second predetermined period of time, as for example 3 seconds (item 78). If an object is not sensed by the object sensor (item 88), the dryer remains on for the second predetermined amount of time e.g., 3 seconds, (item 78) since the object was detected after which time the dryer is turned off and the timer that counts the continuous operation of the dryer is reset (item 88). Similarly, if the dryer is continuously operated for an amount of time greater than the second predetermined amount of time, e.g., 4 minutes, (item 76), the dryer is turned off and the timer is reset, the red light if available may be turned on (item 80) even if an object is detected by the object sensor. Optionally in such case, the dryer remains off and would be turned on for a third predetermined amount of time as for example 5 seconds (item 82). If an object is detected by the object sensor immediately after such third predetermined period of time, the dryer continues to remain off (item 84). Once an object is no longer detected after such third predetermined period of time (item 84), the process continues back to item 62. In this regard, if an object is left in the object sensor's sensing area, the dryer will only operate continuously for the second predetermined amount of time (item 76) and stop and will not revert to normal operation until such object is removed from the object sensor's sensing area.

If the switch is turned to the towel mode and the temperature of the motor is not less than a predetermined level, as for example the first predetermined level, as for example 60° C. (item 90), the red light, if available, is turned on (item 92). When the sensed dryer motor temperature is less than the first predetermined level, the green light, if available, may flash (item 94). If an object is detected by the object sensor (item 96) and if a green light is provided, the green light is turned on and a timer is started for measuring time and a counter is set equal to one (item 98). After a third predetermined period of time passes, as for example 3 seconds (item 100), if an object is detected in the sensing zone (item 102), the timer is reset to zero, and the counter is set to zero, the process (item 104) continues as if it is a dryer mode as described above (item 104). More specifically, if a green light is provided, the green light is turned on, the dryer is turned on and the timer that monitors use of the dryer is turned on (item 70). If an object is not detected by the sensor and the time lapsed is greater than a fourth predetermined amount, as for example eight seconds (item 106), the timer is reset to zero and the counter is set to zero (item 108) and the process begins from the beginning.

As can be seen in an example embodiment, the dryer will not turn on initially when the temperature is not less than a first predetermined level (e.g., 60° C.). The dryer will stop operating when the temperature reaches a second predetermined level (e.g., 70° C.). When in dryer mode, if an object is detected by the object sensor, the dryer will stay on for a predetermined first period time. If an object is not detected after such period of time the dryer turns off. If an object is placed within the sensing area of the sensor, the dryer will operate continuously for a second period of time. After that time period, the dryer will stop and can only turn on again after, optionally a third period of time passes, and after the object has been removed from the sensing area, and the same or a different object has been re-introduced in the sensing area. When in towel mode, the dryer will not turn on after a predetermined period of time after the object sensor has sensed an object in its sensing area. If after such period of time an object is detected by the object sensor the dryer will turn on. If an object is not detected after such period of time and after another period of time, the system resets itself.

In this regard, when in dryer mode, once person attempts to obtain a paper towel, the dryer will turn on (assuming that the dryer motor sensed temperature is below the predetermined levels) and remain on giving an opportunity to the user to begin drying their hands using the dryer and then retrieving the towel to complete the drying process. When in paper towel mode, the dryer does not turn on for a period of time. In this regard, the user can obtain the towel to dry his/her hand(s) and if after a period of time, he/she keeps their hand(s) in the object sensing area, the dryer will turn on helping the user in further drying his/her hand(s).

In an example embodiment, where the waste receptacle is provided as part of the system, the waste receptacle may be provided below the paper towel dispensing opening and below the dryer outlets such that drippings from an object (e.g. a user's hands) that will be dried drip into the waste receptacle. In this regard, the contaminated water from the object is disposed with the waste from the receptacle and does not collect in an area of the dryer or towel dispenser. As such, contaminated water from the object does not collect in any part of the dryer or the towel dispenser, and the problems that are typically associated with the collection of such contaminate water (such as bacteria growth) are alleviated.

In another example embodiment, only a dryer is provided with outlets providing air for drying from opposite sides, i.e., from opposite left and right sides when facing the dryer outlets. In yet another embodiment the dryer as described above in combination with a waste receptacle without a towel dispenser is provided. In yet another example embodiment, a single object sensor is used to provide a signal in response to which the dryer as well as the towel dispenser are operated together or individually.

Although only a few example embodiments have been described in detail above, those skilled in the art will readily appreciate that many modifications are possible in the example embodiments without materially departing from this invention. Accordingly, all such modifications are without materially departing from this invention. Accordingly, all such modifications are intended to be included within the scope of this disclosure as defined in the following claims. It is the express intention of the applicant not to invoke 35 U.S.C. 112, paragraph 6 for any limitations of any of the claims herein, except for those in which the claim expressly uses the words 'means for' together with an associated function.

What is claimed is:

1. A dryer and towel dispenser combination comprising:

a housing;

a towel dispenser within the housing comprising at least a portion for holding a plurality of interfolded towels and for dispensing said towels through a first area;

a sensor having a sensing area for sensing an object that penetrates said sensing area, wherein said sensing area is in front of at least a portion of said first area;

a dryer within the housing comprising a blower, said dryer activated in response to a sensing of said object for drying said object; and a first duct and a second duct coupled to said blower, wherein the first duct comprises a first outlet and wherein the second duct comprises a second outlet, wherein air blown through the first duct discharges through the first outlet and air blown through the second duct discharges through the second outlet, wherein said at least a portion of the towel dispenser for holding said interfolded towels is between the first and second ducts, wherein said blower is located above said at least a portion of the towel dispenser for holding said interfolded towels, wherein said housing comprises a front recess for receiving an object and for dispensing said towels therethrough, wherein said first duct extends along a portion of a first side of said front recess and said second duct extends along a portion of a second side of said front recess opposite the first side, wherein air blown through the first outlet is directed at least toward the second side and air blown through the second outlet is directed toward at least the first side, and wherein air blown through said first and second ducts is at least generally along a plane of a towel dispensed through said dispenser.

2. The combination as recited in claim 1, wherein said object is at least one of both of user's hands.

3. The combination as recited in claim 1, wherein the dryer blows heated air.

4. The combination as recited in claim 1, wherein said towel dispenser dispenses the towel along a path, wherein said path extends between said first and second outlets.

5. The combination as recited in claim 4, wherein said towel dispenser comprises an opening through which the towel will be dispensed, wherein said first and second outlets are below said opening.

6. The combination as recited in claim 4, further comprising a waste receptacle below said first and second outlets.

7. The combination as recited in claim 1, wherein said towel dispenser comprises an opening through which the towel will be dispensed, said opening being elongated along a first direction, wherein said opening is longer along said first direction than along a second direction perpendicular to the first direction, wherein the first and second outlets discharge air blown by the dryer at least along said first direction.

8. The combination as recited in claim 1, wherein when a user faces the combination, the first outlet discharges air blown by the dryer from a right side toward a left side and the second outlet discharges air blown by the dryer from a left side toward a right side as viewed by the user facing said combination.

9. The combination as recited in claim 1, wherein a towel cannot be obtained from said towel dispenser without intercepting said sensing area.

10. The combination as recited in claim 1, further comprising a first area from which a towel may be obtained from said towel dispenser wherein at least a portion of said sensing area and at least a portion of said first area are confined within a vertical distance no greater than 4 inches.

11. The combination as recited in claim 1, wherein said towel dispenser comprises an opening through which the towels will be dispensed, wherein said outlets are below said opening.

12. The combination as recited in claim 10, wherein said towel dispenser comprises an opening through which the towel will be dispensed, said opening being elongated along a first direction, wherein said opening is longer along said first direction than along a second direction perpendicular to the first direction, wherein the first and second outlets discharge air blown by the dryer at least along said first direction.

13. The combination as recited in claim 1, further comprising a waste receptacle below said outlets.

* * * * *